US008235486B2

(12) United States Patent
Negishi et al.

(10) Patent No.: US 8,235,486 B2
(45) Date of Patent: Aug. 7, 2012

(54) RECORDING ELEMENT SUBSTRATE, RECORDING HEAD INCLUDING THE SAME, AND RECORDING HEAD CARTRIDGE

(75) Inventors: Toshio Negishi, Yokohama (JP); Yoshiyuki Imanaka, Kawasaki (JP); Takaaki Yamaguchi, Yokohama (JP); Ryoji Oohashi, Yokohama (JP); Kazushi Fujimoto, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 12/609,372

(22) Filed: Oct. 30, 2009

(65) Prior Publication Data

US 2010/0118068 A1 May 13, 2010

(30) Foreign Application Priority Data

Nov. 13, 2008 (JP) ..... 2008-291107

(51) Int. Cl.
*B41J 29/38* (2006.01)

(52) U.S. Cl. ..... 347/9; 347/10

(58) Field of Classification Search ..... 347/9–10; 714/800–801, 803, 763, 716, 773
See application file for complete search history.

(56) References Cited

U.S. PATENT DOCUMENTS 5,828,386 A * 10/1998 Okada et al. ..... 347/9
6,471,324 B1 10/2002 Maru
2005/0122373 A1 * 6/2005 Katsu et al. ..... 347/22

FOREIGN PATENT DOCUMENTS

JP 08-252909 A 10/1996
JP 2000-141660 A 5/2000

* cited by examiner

*Primary Examiner* — Jason Uhlenhake
(74) *Attorney, Agent, or Firm* — Canon USA Inc IP Division

(57) ABSTRACT

Even when a contact connection failure of electrical connection occurs between a recording head including a recording element substrate, and a recording apparatus, continuous driving of the same heat generating resistive element is suppressed. Blocks in which heat generating resistive elements are not driven are prepared beforehand in a selection target of blocks to be driven in a time-division manner. When an input signal is in a predetermined condition, the block selection target is set to blocks in which heat generating resistive elements are not driven.

6 Claims, 10 Drawing Sheets

FIG.3

| 4-BIT LATCH OUTPUT | | | | 4 TO 16 DECODER OUTPUTS | | | | | | | | | | | | | | | |
|---|---|---|---|---|---|---|---|---|---|---|---|---|---|---|---|---|---|---|---|
| B4L | B3L | B2L | B1L | N16 | N15 | N14 | N13 | N12 | N11 | N10 | N9 | N8 | N7 | N6 | N5 | N4 | N3 | N2 | N1 |
| 0 | 0 | 0 | 0 | L | L | L | L | L | L | L | L | L | L | L | L | L | L | L | H |
| 0 | 0 | 0 | 1 | L | L | L | L | L | L | L | L | L | L | L | L | L | L | H | L |
| 0 | 0 | 1 | 0 | L | L | L | L | L | L | L | L | L | L | L | L | L | H | L | L |
| 0 | 0 | 1 | 1 | L | L | L | L | L | L | L | L | L | L | L | L | H | L | L | L |
| 0 | 1 | 0 | 0 | L | L | L | L | L | L | L | L | L | L | L | H | L | L | L | L |
| 0 | 1 | 0 | 1 | L | L | L | L | L | L | L | L | L | L | H | L | L | L | L | L |
| 0 | 1 | 1 | 0 | L | L | L | L | L | L | L | L | L | H | L | L | L | L | L | L |
| 0 | 1 | 1 | 1 | L | L | L | L | L | L | L | L | H | L | L | L | L | L | L | L |
| 1 | 0 | 0 | 0 | L | L | L | L | L | L | L | H | L | L | L | L | L | L | L | L |
| 1 | 0 | 0 | 1 | L | L | L | L | L | L | H | L | L | L | L | L | L | L | L | L |
| 1 | 0 | 1 | 0 | L | L | L | L | L | H | L | L | L | L | L | L | L | L | L | L |
| 1 | 0 | 1 | 1 | L | L | L | L | H | L | L | L | L | L | L | L | L | L | L | L |
| 1 | 1 | 0 | 0 | L | L | L | H | L | L | L | L | L | L | L | L | L | L | L | L |
| 1 | 1 | 0 | 1 | L | L | H | L | L | L | L | L | L | L | L | L | L | L | L | L |
| 1 | 1 | 1 | 0 | L | H | L | L | L | L | L | L | L | L | L | L | L | L | L | L |
| 1 | 1 | 1 | 1 | H | L | L | L | L | L | L | L | L | L | L | L | L | L | L | L |

FIG.4

| AND GATE | HE | D* | N* |
|---|---|---|---|
| (N.C.) | 0 | D1L | N1 |
| A1 | 0 | D1L | N2 |
| A2 | 0 | D1L | N3 |
| A3 | 0 | D1L | N4 |
| A4 | 0 | D1L | N5 |
| A5 | 0 | D1L | N6 |
| A6 | 0 | D1L | N7 |
| A7 | 0 | D1L | N8 |
| A8 | 0 | D1L | N9 |
| A9 | 0 | D1L | N10 |
| A10 | 0 | D1L | N11 |
| A11 | 0 | D1L | N12 |
| A12 | 0 | D1L | N13 |
| A13 | 0 | D1L | N14 |
| A14 | 0 | D1L | N15 |
| (N.C.) | 0 | D1L | N16 |
| (N.C.) | 0 | D2L | N1 |
| A15 | 0 | D2L | N2 |
| A16 | 0 | D2L | N3 |
| A17 | 0 | D2L | N4 |
| A18 | 0 | D2L | N5 |
| A19 | 0 | D2L | N6 |
| A20 | 0 | D2L | N7 |
| A21 | 0 | D2L | N8 |
| A22 | 0 | D2L | N9 |
| A23 | 0 | D2L | N10 |
| A24 | 0 | D2L | N11 |
| A25 | 0 | D2L | N12 |
| A26 | 0 | D2L | N13 |
| A27 | 0 | D2L | N14 |
| A28 | 0 | D2L | N15 |
| (N.C.) | 0 | D2L | N16 |

| AND GATE | HE | D* | N* |
|---|---|---|---|
| (N.C.) | 0 | D3L | N1 |
| A29 | 0 | D3L | N2 |
| A30 | 0 | D3L | N3 |
| A31 | 0 | D3L | N4 |
| A32 | 0 | D3L | N5 |
| A33 | 0 | D3L | N6 |
| A34 | 0 | D3L | N7 |
| A35 | 0 | D3L | N8 |
| A36 | 0 | D3L | N9 |
| A37 | 0 | D3L | N10 |
| A38 | 0 | D3L | N11 |
| A39 | 0 | D3L | N12 |
| A40 | 0 | D3L | N13 |
| A41 | 0 | D3L | N14 |
| A42 | 0 | D3L | N15 |
| (N.C.) | 0 | D3L | N16 |
| (N.C.) | 0 | D4L | N1 |
| A43 | 0 | D4L | N2 |
| A44 | 0 | D4L | N3 |
| A45 | 0 | D4L | N4 |
| A46 | 0 | D4L | N5 |
| A47 | 0 | D4L | N6 |
| A48 | 0 | D4L | N7 |
| A49 | 0 | D4L | N8 |
| A50 | 0 | D4L | N9 |
| A51 | 0 | D4L | N10 |
| A52 | 0 | D4L | N11 |
| A53 | 0 | D4L | N12 |
| A54 | 0 | D4L | N13 |
| A55 | 0 | D4L | N14 |
| A56 | 0 | D4L | N15 |
| (N.C.) | 0 | D4L | N16 |

FIG.8
PRIOR ART

| AND GATE | HE | D* | N* |
|---|---|---|---|
| A1 | 0 | D1L | N1 |
| A2 | 0 | D1L | N2 |
| A3 | 0 | D1L | N3 |
| A4 | 0 | D1L | N4 |
| A5 | 0 | D1L | N5 |
| A6 | 0 | D1L | N6 |
| A7 | 0 | D1L | N7 |
| A8 | 0 | D1L | N8 |
| A9 | 0 | D1L | N9 |
| A10 | 0 | D1L | N10 |
| A11 | 0 | D1L | N11 |
| A12 | 0 | D1L | N12 |
| A13 | 0 | D1L | N13 |
| A14 | 0 | D1L | N14 |
| A15 | 0 | D1L | N15 |
| A16 | 0 | D1L | N16 |
| A17 | 0 | D2L | N1 |
| A18 | 0 | D2L | N2 |
| A19 | 0 | D2L | N3 |
| A20 | 0 | D2L | N4 |
| A21 | 0 | D2L | N5 |
| A22 | 0 | D2L | N6 |
| A23 | 0 | D2L | N7 |
| A24 | 0 | D2L | N8 |
| A25 | 0 | D2L | N9 |
| A26 | 0 | D2L | N10 |
| A27 | 0 | D2L | N11 |
| A28 | 0 | D2L | N12 |
| A29 | 0 | D2L | N13 |
| A30 | 0 | D2L | N14 |
| A31 | 0 | D2L | N15 |
| A32 | 0 | D2L | N16 |

| AND GATE | HE | D* | N* |
|---|---|---|---|
| A33 | 0 | D3L | N1 |
| A34 | 0 | D3L | N2 |
| A35 | 0 | D3L | N3 |
| A36 | 0 | D3L | N4 |
| A37 | 0 | D3L | N5 |
| A38 | 0 | D3L | N6 |
| A39 | 0 | D3L | N7 |
| A40 | 0 | D3L | N8 |
| A41 | 0 | D3L | N9 |
| A42 | 0 | D3L | N10 |
| A43 | 0 | D3L | N11 |
| A44 | 0 | D3L | N12 |
| A45 | 0 | D3L | N13 |
| A46 | 0 | D3L | N14 |
| A47 | 0 | D3L | N15 |
| A48 | 0 | D3L | N16 |
| A49 | 0 | D4L | N1 |
| A50 | 0 | D4L | N2 |
| A51 | 0 | D4L | N3 |
| A52 | 0 | D4L | N4 |
| A53 | 0 | D4L | N5 |
| A54 | 0 | D4L | N6 |
| A55 | 0 | D4L | N7 |
| A56 | 0 | D4L | N8 |
| A57 | 0 | D4L | N9 |
| A58 | 0 | D4L | N10 |
| A59 | 0 | D4L | N11 |
| A60 | 0 | D4L | N12 |
| A61 | 0 | D4L | N13 |
| A62 | 0 | D4L | N14 |
| A63 | 0 | D4L | N15 |
| A64 | 0 | D4L | N16 |

RECORDING ELEMENT SUBSTRATE, RECORDING HEAD INCLUDING THE SAME, AND RECORDING HEAD CARTRIDGE

BACKGROUND OF THE INVENTION

1. Field of the Invention

The present invention relates to a recording element substrate, a recording head including the recording element substrate, and a recording head cartridge. More specifically, the invention relates to an ink jet recording element substrate for recording by using ink.

2. Description of the Related Art

In a recording head of an ink jet system, for example, in order to operate a plurality of heat generating resistive elements provided in the recording head at different timings, time-division driving is performed, in which the plurality of heat generating resistive elements are divided into a plurality of blocks and each of the blocks is driven in sequence.

FIG. 7 is a block diagram illustrating an example configuration of a recording element substrate 111, which includes conventional heat generating resistive elements. FIG. 7 illustrates heat generating resistive elements (heaters) H1 to H64 arrayed in a row, and switching elements T1 to T64. AND circuits A1 to A64 constitute a recording element selection circuit.

Recording data DATA input to an input terminal 107 is transferred to a shift register 104, and then transferred to a shift register 101. A latch circuit 105 latches the data of the shift register 104. A latch circuit 102 latches the data of the shift register 101.

A clock CLK for operating the shift register is input to an input terminal 110. A heat enable signal HE for controlling ON-time of the switching elements T1 to T64 from the outside is input to an input terminal 108. A latch signal LT is input to an input terminal 109. An AND circuit 103 calculates logical products of the heat enable signal HE and outputs D1 to D4 of the 4-bit latch circuit 102 to output recording data signals D1L to D4L.

The recording element substrate 111 includes a heater power (VH) input terminal for inputting a driving voltage of the heat generating resistive elements and a GND (GNDH) terminal for inputting a ground level. The recording element substrate further includes a logical power (VDD) input terminal for inputting a voltage for a logical circuit and a GND (VSS) terminal for the logical circuit.

Logical levels of the input terminals have been set to GND level by pull-down resistance. Thus, when a contact is open, a 4-bit value of the recording data (DATA) that is input to the shift register 104 becomes "0000".

Next, a signal flow when a recording operation is performed will be described. Recording data input from a recording apparatus is input to the shift register 104, which constitutes a logical circuit, and divided into recording data signals D1L to D4L and block control signals B1L to B4L. A decoder 106 converts the block control signals into block selection signals N1 to N16. The recording element selection circuits (AND circuits) A1 to A6 receives the recording data signals D1L to D4L and the block selection signals N1 to N6, and perform logical product calculation to determine the heat generating resistive elements to be driven.

Such a recording head is mounted on a carriage of the recording apparatus. A contact pad (contact) of the recording head side and a contact pad (contact) of the carriage side are connected to each other by pressure. This connection realizes electrical connection (may simply be referred to as a contact, hereinafter) between a control unit of the recording apparatus and the recording element substrate of the recording head, thereby enabling power supplying and communication.

In the connected portion, a contact failure having no contact (hereinafter, simply referred to as contact open), or a contact failure in which adjacent contacts are electrically short-circuited (hereinafter, simply referred to as a contact short-circuit) may occur. In such a case, the recording data sent from the recording apparatus may not be correctly input to the recording head, causing deterioration in recording quality.

FIG. 9 illustrates a recording operation when the recording apparatus and the recording head are normally interconnected. FIG. 9 is a conceptual diagram illustrating the block control signals B1L to B3L during the recording operation, a time sequence of the block selection signals N1 to N6, which are decoder output values, and positions of dots on a recording medium implemented by the recording element.

Numerical values 1 to 64 of recording dots correspond to numbers of heaters belonging to a heater array 406. Values (N1 to N64) of the block selection signals, signal levels and time axes (time chart) of the block control signals, and positions of dots recorded in the recording medium correspond to one another.

FIG. 9 illustrates a recording state during 300 microseconds. In a block control signal timing-chart, at time 0, the block control signals B1L to B4L are all at low levels (L), and N1 is selected as a block selection signal. In the block N1, recording elements (nozzles) H1, H17, H33, and H49 are simultaneously driven to record a dot 1, a dot 17, a dot 33, and a dot 49.

Then, according to logical level switching of the block control signals B1L to B4L, the decoder 106 sequentially outputs block selection signals N1 to N16.

FIG. 8 is a table illustrating the recording element selection circuits A1 to A64, which become active based on combinations of the values N1 to N16 of the block selection signals, the values D1L to D4L of the recording data signals, and values of heat enable signals HE.

FIG. 10 illustrates a case where the electrical contact of the input terminal 107 is disconnected at a timing T after the start of the recording operation. In this case, as described above, because of pull-down resistance, irrespective of values of the input recording data, values of recording data (DATA) input to the shift register 104 become "0000". Hence, values latched by the latch circuit 105 also become "0000", causing logical levels of all of the block control signals B1L to B4L to be low.

Thus, as illustrated in FIG. 9, the block selection signals may normally be switched to N12, N13, and N14 in sequence. However, because of the disconnected electrical contact, as illustrated in FIG. 10, N1 is always selected as a block selection signal. As a result, recording is continued while the recording elements H1, H17, H33, and H49 belonging to the heater array 406 are always selected.

There is a method for detecting such a contact failure. A method discussed inn Japanese Patent Application Laid-Open No. 8-252909 calculates a logical product of all signals input to a recording element substrate, and detects a contact failure based on a result of the calculation. A method discussed in Japanese Patent Application Laid-Open No. 2000-141660 monitors a voltage supplied to a logical circuit for driving a heater, and detects a contact failure based on a result of the monitoring.

However, because of an increase in circuit size resulting from a higher density of the nozzles of the recording head and higher performance of the recording head, a circuit space for the circuit of detecting contact failures may be difficult to provide. An object of the present invention is to provide a recording element substrate, a recording head including the same, and a recording head cartridge, which improves the issue described above.

SUMMARY OF THE INVENTION

The present invention is directed to a recording element substrate, a recording head including the same, and a recording head cartridge in which when a contact failure occurs between the recording head and a recording apparatus body, a temperature increase caused by continuous driving of heat generating resistive elements is prevented.

According to an aspect of the present invention, a recording element substrate for driving a recording element array including a plurality of recording elements, which is divided into a predetermined number of blocks, in a time-division manner, includes an input unit configured to input data, and a control unit configured to perform time-division control by associating the predetermined number of blocks, to which the recording elements have been assigned, and blocks, to which no recording elements have been assigned, with values of the data, and selecting blocks associated with the values of the data, wherein in case that the values of the data are predetermined values, the control unit selects the blocks to which no recording elements have been assigned.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 illustrates a truth value table for a decoder 506 according to the first exemplary embodiment of the present invention.

FIG. 4 illustrates an active condition input signal table for a recording element selection circuit according to the first exemplary embodiment of the present invention.

FIG. 8 illustrates an active condition input table for a recording element selection circuit according to a conventional recording element substrate.

DESCRIPTION OF THE EMBODIMENTS

The accompanying drawings, which are incorporated in and constitute a part of the specification, illustrate exemplary embodiments, features, and aspects of the invention and, together with the description, serve to explain the principles of the invention.

Hereinbelow, a first exemplary embodiment of the present invention will be described. A recording head includes heat generating resistive elements as recording elements. The recording head includes arrays of recording elements each one of arrays arranged on the left side and right side of one ink supply port. One recording element array (heater array) includes fifty six recording elements. The fifty-six recording elements are divided into fourteen blocks (number of divided blocks N=14), and four recording elements included in each block are simultaneously driven (number of simultaneously driven elements M=4). Four block signals B1L to B4L for this block driving are assigned to the recording elements.

Figure 2A:
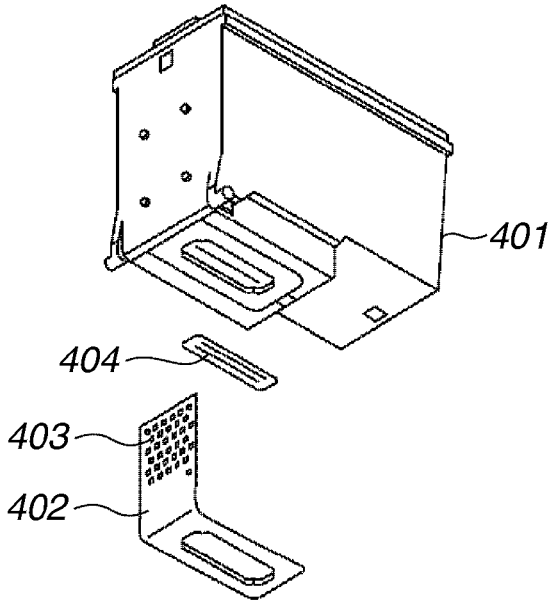
FIG. 2A is an appearance perspective diagram illustrating an outline of a recording head including the recording element substrate according to the first exemplary embodiment of the present invention.

FIG. 2A is an appearance perspective diagram illustrating a configuration of a recording head 401 in which a recording apparatus and a recording head are detachable. The recording head 401 includes an electrode 403 for receiving an electrical signal supplied from the recording apparatus. Based on this electrical signal, recording elements on a recording element substrate 404 are driven to perform recording.

Figure 2B:
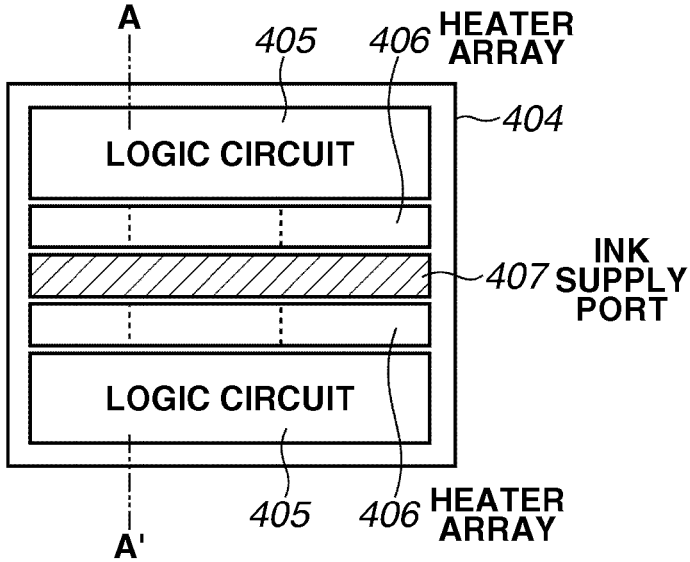
FIG. 2B is an enlarged diagram illustrating the recording element substrate according to the first exemplary embodiment.

A conductive Tape Automated Bonding (TAB) 402 connects electrically the recording element substrate 404 and the electrode 403. FIG. 2B is an enlarged diagram of the recording element substrate 404. As described above, heater arrays 406 are disposed on the left side and the right side of an ink supply port 407. Each heater array includes a logical circuit 405 for driving the heater array.

The logical circuit includes switching elements for selecting heaters, AND circuits, a shift register for latching input data, a latch circuit, and the like.

Figure 2C:
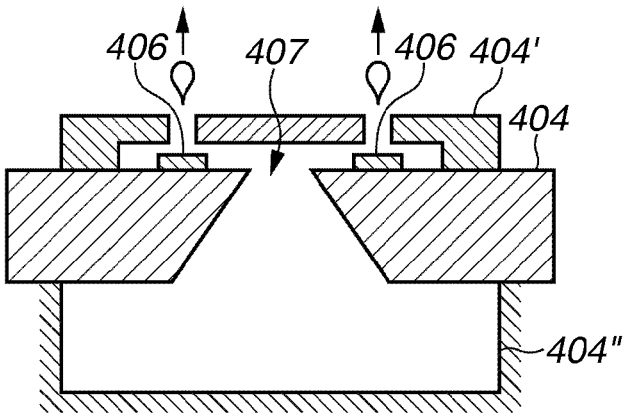
FIG. 2C is a sectional diagram of the recording element substrate cut along a line A-A' according to the first exemplary embodiment of the present invention.

FIG. 2C is a schematic sectional diagram of the recording element substrate 404 taken along line A-A'. Heater arrays 406 are disposed on both sides of the ink supply port 407 of the recording element substrate 404. The exemplary embodiment illustrates only an example of an element substrate 404' in which a discharge port is formed, and an element substrate 404" in which a flow path for supplying ink to the ink supply port is formed. However, configurations of a discharge port and an ink flow path and configurations of the element substrates 404' and 404" including them are not limited to these configurations.

Figure 1:
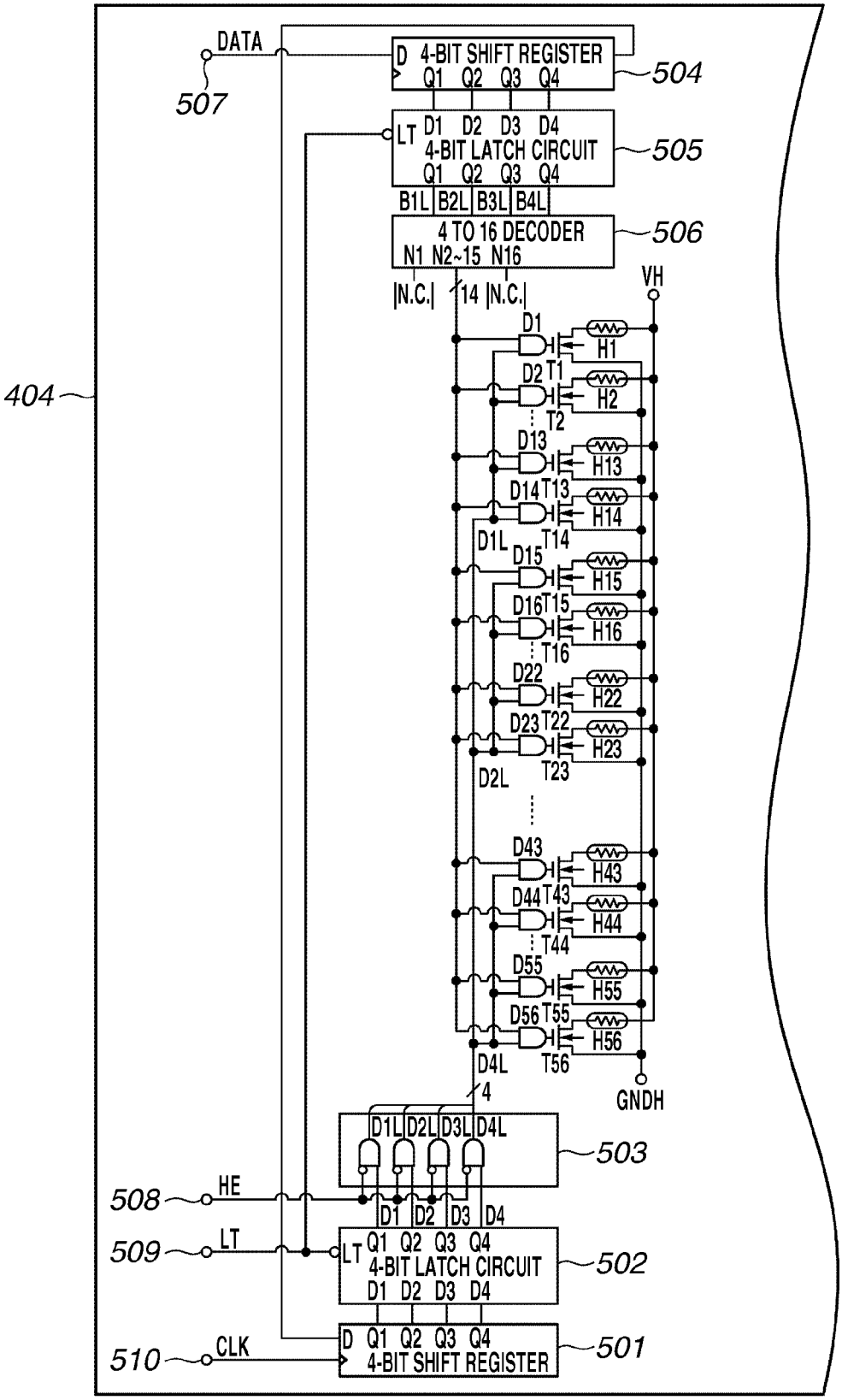
FIG. 1 is a block diagram illustrating a recording element substrate according to a first exemplary embodiment of the present invention.

FIG. 1 is a block diagram illustrating circuitry mounted on the recording element substrate 404 for the heat generating resistive elements (recording elements) of the recording head of the exemplary embodiment, describing heat generating resistive elements for one array.

In the block diagram illustrated in FIG. 1, for supplying driving voltages to the heat generating resistive elements, two members, i.e., a heater power source (VH) and a GND voltage (GNDH) are provided on the recording element substrate 404. The recording element substrate 404 includes, as wiring lines for signals supplied from a recording apparatus body, data (DATA) for recording data, a clock signal (CLK), a heat enable signal (HE), i.e., a heater driving signal, and a latch signal (TL).

The recording element substrate 404 includes a recording signal input terminal 507 for inputting recording data, a driving signal input terminal (heat enable signal) 508, a latch signal input terminal 509, and a clock signal input terminal 510. This circuit is configured such that recording data signals D1L to D4L and block control signals B1L to B4L are generated from recording data input as a recording signal from the input terminal 507 by the shift register and the latch circuit to control driving of the heat generating resistive elements.

In FIG. 1, recording data (DATA) is serially input to a 4-bit shift register 504 based on the clock signal CLK. A 4-bit latch circuit 505 transfers in parallel block control signals of 4 bits stored in the 4-bit shift register 504 based on the latch signal LT to latch the signals.

A 4 to 16 decoder 506 receives the block control signals B1L to B4L supplied from the 4-bit latch circuit 505 to generate block selection signals N1 to N16 for time-division driving.

Recording control data among the data stored in the 4-bit shift register 504 are shifted to be output according to the clock signal CLK, and serially input to a 4-bit shift register 501. A 4-bit latch circuit 502 latches data signals of 4 bits stored in the 4-bit shift register 501 according to the latch signal LT.

An AND circuit 503 calculates logical products of the heat enable signal HE and outputs D1 to D4 of the 4-bit latch circuit 502 to output recording data signals D1L to D4L.

Switching elements T1 to T56 control energization of the heat generating resistive elements H1 to H56, and recording elements selection circuits A1 to A56 are disposed corresponding to the switching elements T1 to T56. The recording element selection circuits A1 to A56 receive any one of the recording data signals D1L to D4L output from the AND circuit 503 and any one of the block selection signals N2 to N15 output from the 4 to 16 decoder 506, and execute a logical operation AND of the two signals.

Then, outputs from the recording element selection circuits A1 to A56 are input to the corresponding switching elements T1 to T56 to control energization of the connected heat generating resistive elements H1 to H56. In other words, based on any signals selected from the recording data signals D1L to D4L output from the AND circuit 503 and the block selection signals N2 to N15 output from the 4 to 16 decoder 506, driving timing and a pulse width are determined for the heat generating resistive elements.

In this circuitry, the heat enable signal HE becomes active at a negative logic to enable an operation. In other words, the heat generating resistive elements are driven when the logical level of the heat enable signal HE is "Low".

Among the outputs of the 4 to 16 decoder 506, the block selection signals N1 and N16 are not connected to any recording element selection circuits. In other words, no heat generating resistive elements are assigned to the blocks N1 and N16.

Thus, when a logical level of the block N1 or N16 is "High", even if the logical level of the heat enable signal HE is "Low", no heat generating resistive element is driven.

FIG. 3 illustrates a truth value table of the 4 to 16 decoder 506. Based on combinations of logical levels (High/Low) of the block control signals B1L to B4L, the block selection signals N1 to N16 are assigned beforehand. For example, when logical levels of the block control signals B1L to B4L become "High", the block selection signal N1 is selected.

FIG. 4 is a table illustrating which of the recording element selection circuits A1 to A56 become active based on combinations of the block selection signals N1 to N16, the recording data signals D1L to D4L, and the heat enable signal HE.

The table illustrates that when signals HE, D*(D1L to D4L), and N* (N1 to N16) written in the fields of the recording element selection circuits are input, outputs of the corresponding recording element selection circuits become active.

In the table of FIG. 4, a value "0" indicates "Low", and a value "1" indicates "High". For example, the recording element selection circuit A1 becomes active when a logical level of the HE signal is "Low" (active), a logical level of D1L is "High", and a logical level of N2 is "High", and the corresponding switching element T1 is turned ON to drive the heater H1. The D1L to D4L can be set active, and hence the recording element selection circuits A1, A15, A29, and A43 can be simultaneously driven.

Figure 5A:
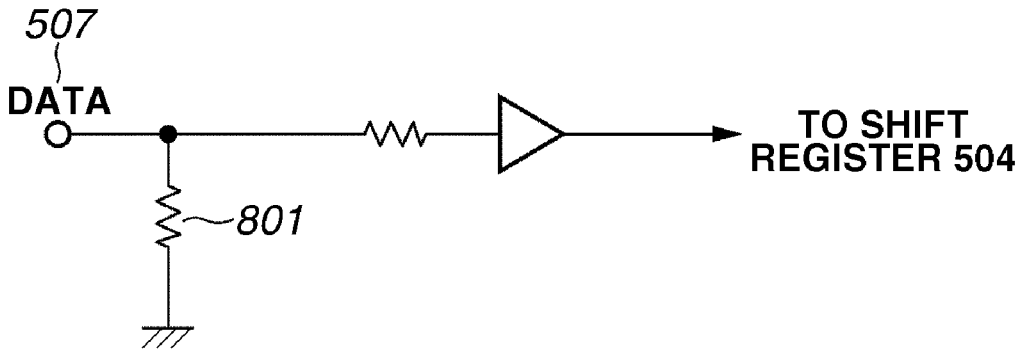
FIG. 5A is a circuit diagram illustrating a DATA input unit according to the first exemplary embodiment of the present invention.

In the exemplary embodiment, a pull-down resistor 801 illustrated in FIG. 5A is connected to the input terminal 507, which is to input the recording data DATA. When a contact failure of an open condition occurs at the input terminal 507, a GND level ("Low" level) is automatically set. This occurs because the input terminal 507 is set to a potential of the recording element substrate.

As a recording operation, with the input of the clock CLK, all bits of the input signal recording data (DATA) are input serially as Low level signals "0000" to the shift register 504. As a result, values of the block control signals B1L to B4L output from the 4-bit latch circuit 505 become "0000", and hence the block selection signal N1 is selected as the output of the 4 to 16 decoder to be a "High" level.

However, as described above, the "High" logical level of the N1 means that no heat generating resistive element is assigned, and hence no heat generating resistive element is driven. FIG. 4 illustrates that a plurality of vacant blocks such as N1 and N16 among the block selection signals N1 to N16 are included.

Further, with this configuration, when contact short-circuiting occurs between the input terminal 507 of the recording data (DATA) and the logical power source VDD, the input signal recording data (DATA) are serially input as data of "High" levels to the shift register 504.

As a result, the block control signals B1L to B4L output from the 4-bit latch circuit 505 become "1111". In other words, the block selection signal N16 is selected as an output result of the 4 to 16 decoder to become "High". When the logical level of N16 becomes "High", blocks to which no heat generating resistive elements have been assigned are selected, and no heat generating resistive element is driven.

Figure 5B:
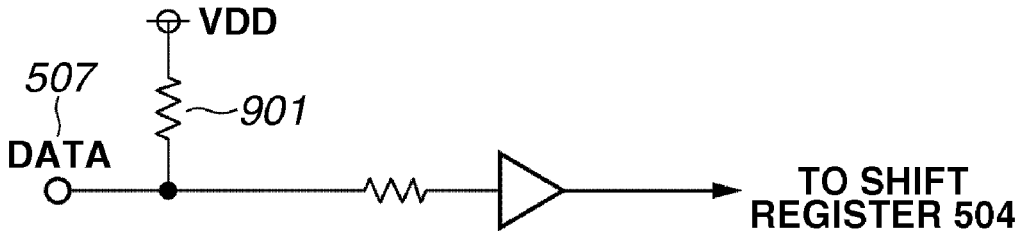
FIG. 5B is a circuit diagram illustrating a DATA input unit according to a second exemplary embodiment of the present invention.

As circuitry, which is a second exemplary embodiment of the present invention, a pull-up resistor 901 illustrated in FIG. 5B may be connected to an input terminal 507 of recording data (DATA). In the circuitry of the exemplary embodiment, when the input terminal 507 is set in a contact open condition, the input terminal is set to a logical power supply voltage VDD level. As a result, logical levels of the recording data (DATA) input to a shift register 504 are input as all bit High level signals "1111".

Recording Apparatus

Figure 6:
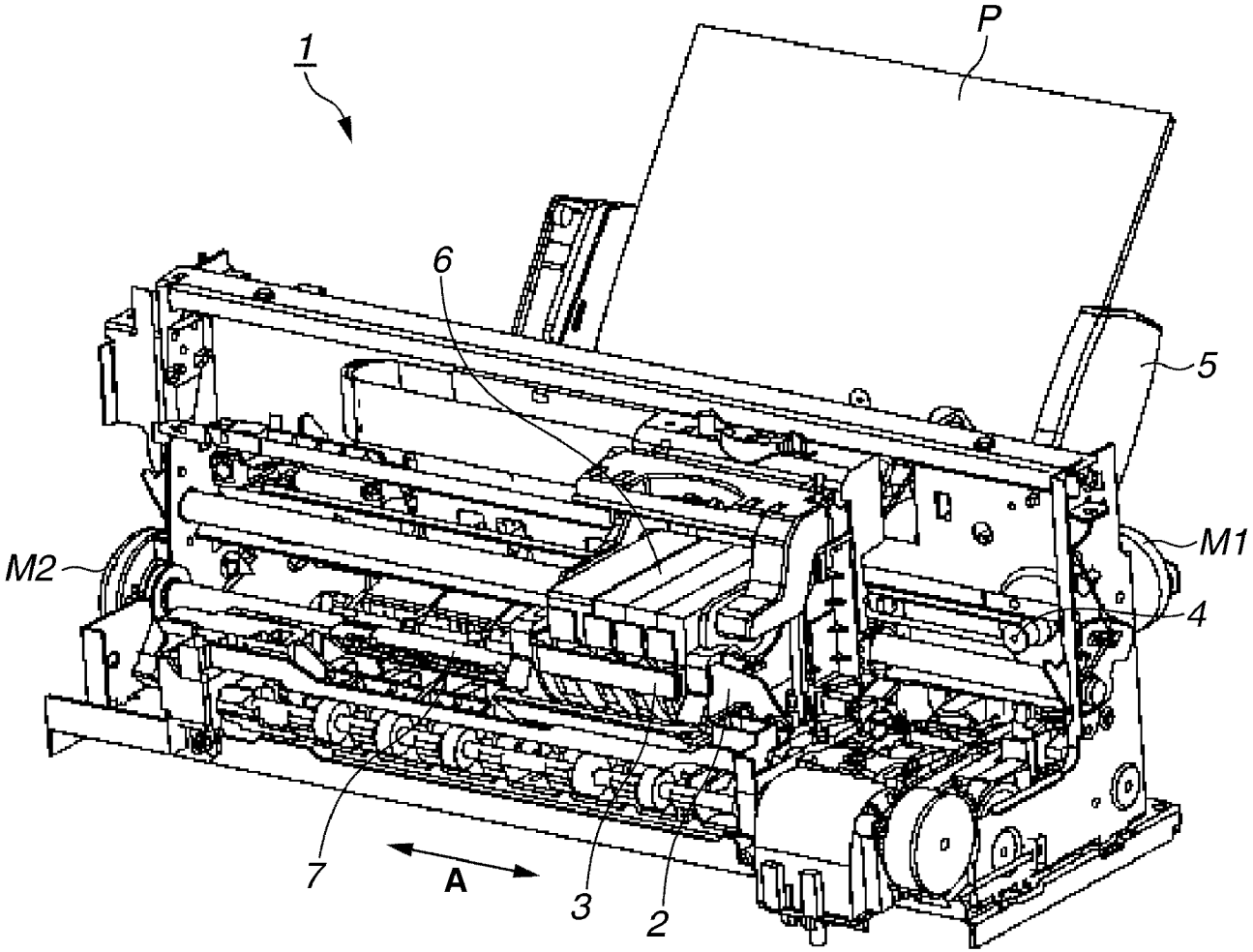
FIG. 6 is a perspective diagram illustrating a recording apparatus.
Figure 7:
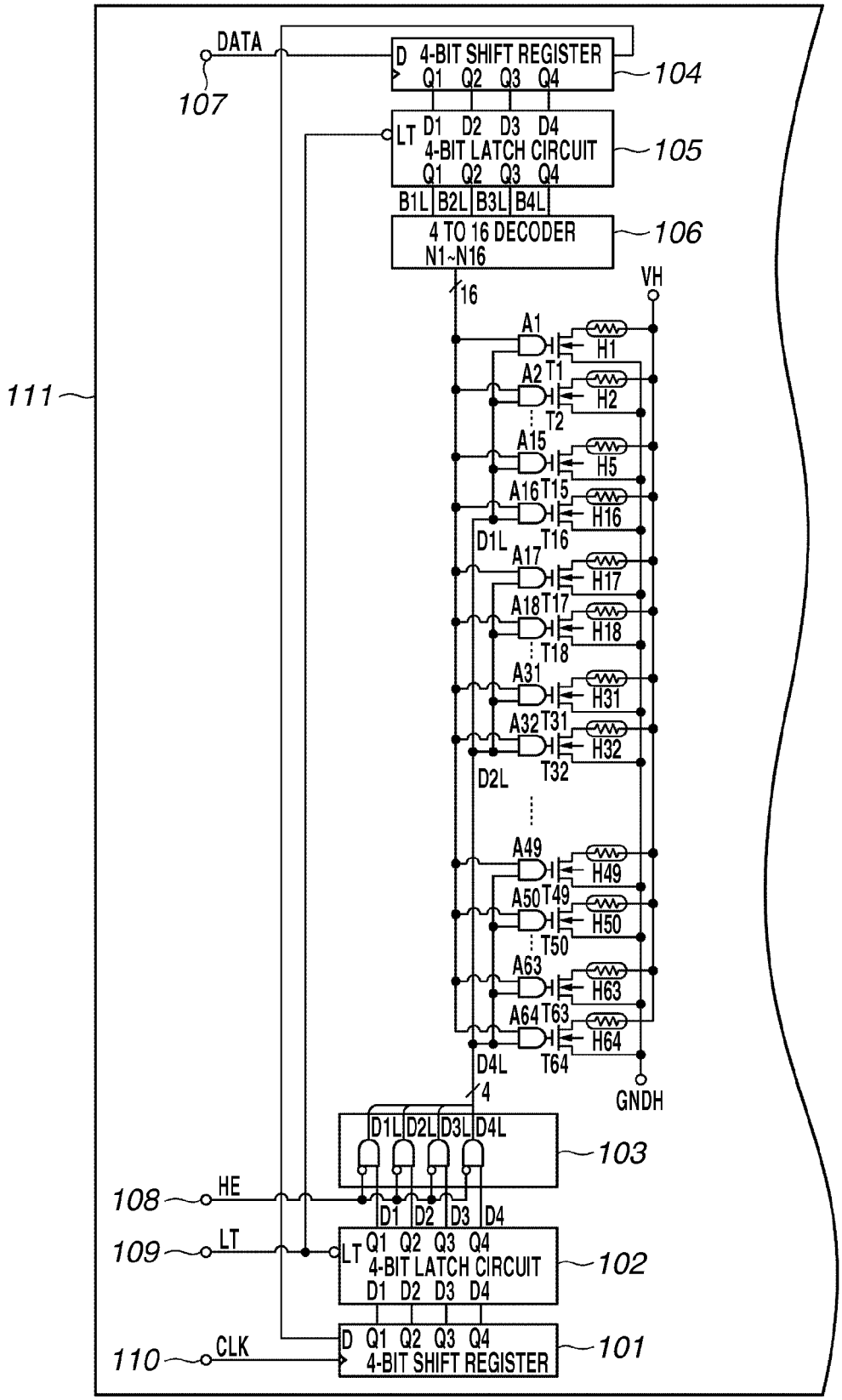
FIG.7 PRIOR ART
FIG. 7 is a block diagram illustrating circuitry of a conventional recording element substrate.
Figure 9:
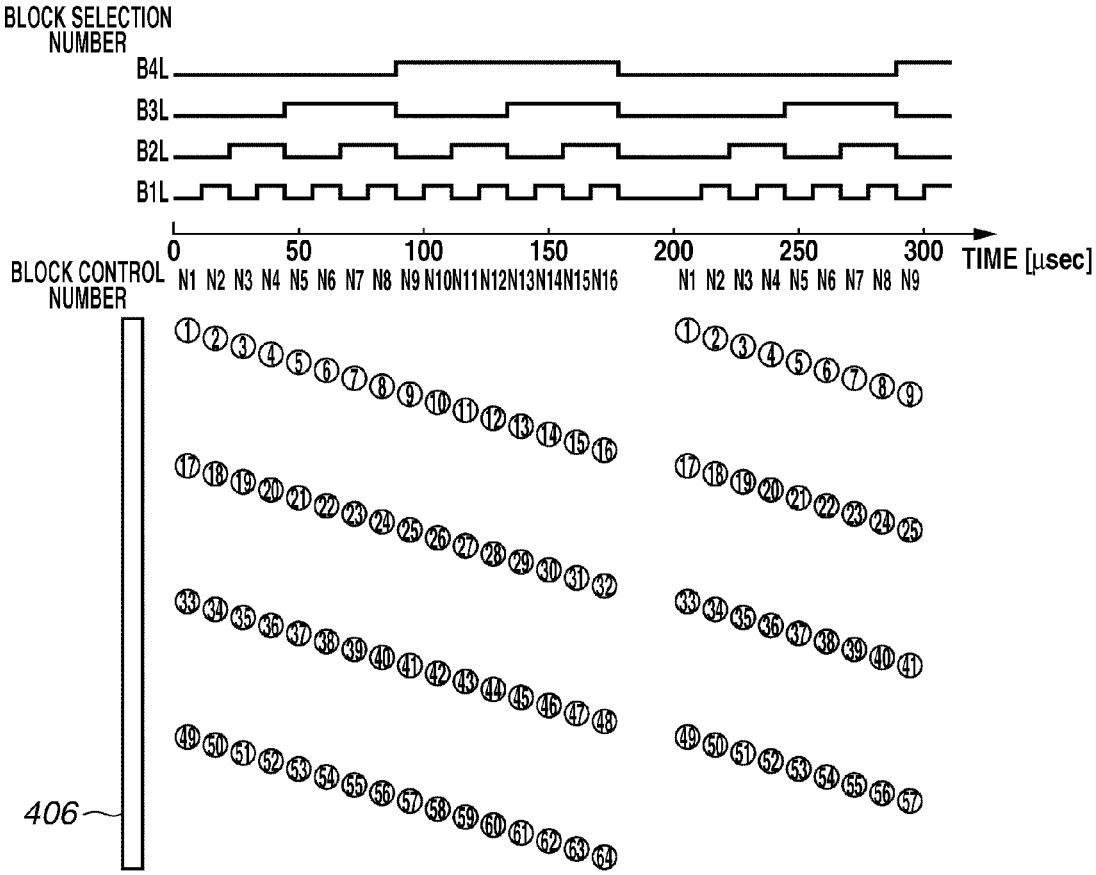
FIG.9 PRIOR ART
FIG. 9 illustrates a printing state by a recording head, which includes the conventional recording element substrate.
Figure 10:
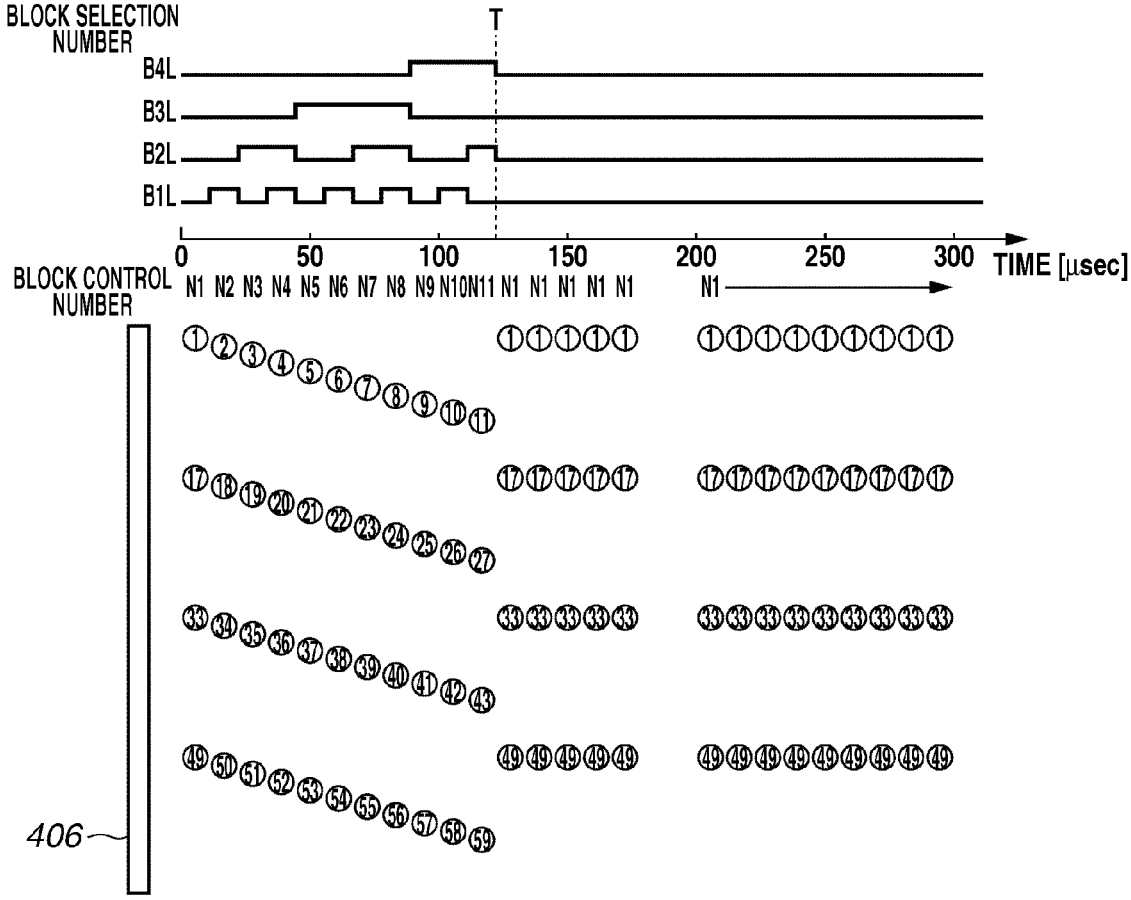
FIG.10 PRIOR ART
FIG. 10 illustrates a printing condition at the time of a contact failure according to the conventional recording head.

FIG. 6 is an appearance perspective diagram illustrating an outline of a configuration of an ink jet recording apparatus 1 to which the exemplary embodiment described above is applied.

A transmission mechanism 4 transmits a driving force generated by a carriage motor M1 to a carriage 2 on which a recording head 3 is mounted to reciprocate the carriage 2 in an arrow direction A. The carriage 2 and the recording head 3 have coupled surfaces thereof appropriately brought into contact with each other to achieve and maintain required electrical connection.

A recording medium P is fed via a paper feeding mechanism 5 driven by a feed motor M2, and conveyed to a recording position. At the recording position, the recording head 3 discharges ink to the recording material P to perform recording. A convey roller 7 for conveying the recording medium P is driven by the feed motor M2.

Not only the recording head 3 but also an ink cartridge 6 for storing ink to be supplied to the recording head 3 are mounted on the carriage 2 of the recording apparatus 1. The ink cartridge 6 is detachable from the carriage 2.

The carriage 2 includes four ink cartridges for storing inks of magenta (M), cyan (C), yellow (Y), and black (K). These four ink cartridges are independently detachable.

The exemplary embodiments of the present invention have been described above. However, the present invention is not limited to the exemplary embodiments. For example, block assignment, the number of blocks, and the number of data bits are not limited to the numerical values described above.

The aforementioned recording apparatus is a serial type recording apparatus, which performs scanning with the recording head. However, a recording apparatus including a recording head having a width corresponding to that of a recording medium may be employed.

The recording head may employ a configuration of a recording head cartridge in which an ink tank as a liquid storage container for performing recording and a recording element substrate are integrally formed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-291107 filed Nov. 13, 2008, which is hereby incorporated by reference herein in its entirety.

What is claimed is:

1. A recording element substrate comprising:

a recording element array including a plurality of recording elements, the plurality of recording elements being divided into a plurality of blocks;

a driving unit configured to drive the plurality of recording elements in a time-division manner with respect to each of the plurality of blocks;

an input terminal to which data is input from the outside; and a decoder unit configured to decode the data input to the input terminal to generate a signal for performing time-division driving, wherein the driving unit does not use the signal generated by decoding data of which the level of all bits is "High" and the signal generated by decoding data of which the level of all bits is "Low".

2. The recording element substrate according to claim 1, wherein the data input to the input terminal is serially input to a shift register, and the data output from the shift register is latched by a latch circuit.

3. The recording element substrate according to claim 1, wherein the input terminal is either grounded via a pull-down resistor, or is connected to power source via a pull-up resistor.

4. The recording element substrate according to claim 1, wherein recording data for driving the plurality of recording elements is also input to the input terminal.

5. A recording head comprising:

a recording element array including a plurality of recording elements, the plurality of recording elements being divided into a plurality of blocks;

a driving unit configured to drive the plurality of recording elements in a time-division manner with respect to each of the plurality of blocks;

an input terminal to which data is input from the outside; and a decoder unit configured to decode the data input to the input terminal to generate a signal for performing time-division driving, wherein the driving unit does not use the signal generated by decoding data of which the level of all bits is "High" and the signal generated by decoding data of which the level of all bits is "Low".

6. A recording head cartridge comprising:

a recording head, having, a recording element array including a plurality of recording elements, the plurality of recording elements being divided into a plurality of blocks;

a driving unit configured to drive the plurality of recording elements in a time-division manner with respect to each of the plurality of blocks;

an input terminal to which data is input from the outside; and a decoder unit configured to decode the data input to the input terminal to generate a signal for performing time-division driving; and a liquid storage container for recording ink integrally formed in the recording head, wherein the driving unit does not use the signal generated by decoding data of which the level of all bits is "High" and the signal generated by decoding data of which the level of all bits is "Low".

* * * * *